US007322621B2

(12) United States Patent
Liao

(10) Patent No.: US 7,322,621 B2
(45) Date of Patent: Jan. 29, 2008

(54) MAGNETIC LOCK

(76) Inventor: Li-Shih Liao, No. 3, Lane 32, Gaocing Road, Yangmei Township, Taoyuan County, 326 (TW)

( * ) Notice: Subject to any disclaimer, the term of this patent is extended or adjusted under 35 U.S.C. 154(b) by 92 days.

(21) Appl. No.: 11/272,708

(22) Filed: Nov. 15, 2005

(65) Prior Publication Data

US 2006/0226663 A1 Oct. 12, 2006

(30) Foreign Application Priority Data

Aug. 4, 2005 (TW) ..... 94205468 U

(51) Int. Cl.
*E05B 15/02* (2006.01)

(52) U.S. Cl. ..... 292/341.16

(58) Field of Classification Search ..... 292/341.16, 292/251.5, 201, 216, 341.15, 341.18
See application file for complete search history.

(56) References Cited

U.S. PATENT DOCUMENTS

| | | | | |
|---|---|---|---|---|
| 4,471,983 | A * | 9/1984 | Bischoff et al. | 292/341.16 |
| 5,934,720 | A * | 8/1999 | Karalius | 292/341.16 |
| 6,874,830 | B2 * | 4/2005 | Bashford | 292/341.16 |
| 7,144,053 | B2 * | 12/2006 | Bashford | 292/341.16 |
| 7,185,928 | B1 * | 3/2007 | Liao | 292/341.16 |

* cited by examiner

*Primary Examiner*—Jennifer H. Gay
*Assistant Examiner*—Mark Williams
(74) *Attorney, Agent, or Firm*—Rosenberg, Klein & Lee

(57) ABSTRACT

A magnetic lock is disclosed to include a latch for locking, a holder member supported on a spring and carrying an electromagnetic valve, which has a reciprocating rod fixedly mounted with a stop block for controlling the retraction of the latch, and an adjustment screw for controlling the holder member between a first position where the magnetic lock is locked when electrically connected and a second position where the magnetic lock is unlocked when electrically connected.

2 Claims, 8 Drawing Sheets

MAGNETIC LOCK

BACKGROUND OF THE INVENTION

1. Field of the Invention

The present invention relates to locks and more particularly, to a magnetic lock that can be conveniently and selectively adjusted between two reversed modes.

2. Description of the Related Art

Commercial magnetic locks are made in two different types for use in different conditions, i.e., the type that is unlocked when electrically connected and the type that is locked when electrically connected. Because a magnetic lock manufacturer has to make two different types of magnetic locks to satisfy market demand, the inventory control is complicated and, the manufacturing cost is relatively increased.

In order to eliminate the aforesaid drawback, the inventor invented a magnetic lock that is adjustable between two positions to have the lock be unlocked or locked when electrically connected. This invention was filed on Apr. 14, 1998 in Taiwan and allowed for patent under patent publication no. 384904.

U.S. Pat. No. 6,299,225, issued on Oct. 9, 2001, discloses a lock entitled "ELECTRICAL LOCK DEVICE". This structure of lock, as shown in FIGS. 1A and 1B, comprises a housing 60, a lever 61, a solenoid device 62, a cover 63, and a casing 64. The solenoid device 62 is installed in a bracket 621, having a plunger 622, which has a front end connected to a block 623. The bracket 621 has a plurality of screw holes 624 at the bottom side. The housing 60 has an elongated slot 65 and two screw holes 66 corresponding to the screw holes 624 of the bracket 621. A knob 67 and a fastener 68 are respectively mounted in the elongated slot 65 and one of the screw holes 66 and fastened to the respective screw holes 624 at the bracket 621 to selectively secure the solenoid device 62 to the chamber 601. By means of changing the position of the block 623 to further control on/off of the lever 61, the lock is selectively set between the position of "Locking when electrically connected" and the position of "Unlocking when electrically connected".

This design of electrical lock device is functional. However, before moving the solenoid device 62, the user must detach the cover 63 and unfasten the fastener 68. Therefore, it is inconvenient to adjust this design of electrical lock device.

Further, U.S. Pat. No. 6,874,830 discloses another design of lock device entitled "ELECTRIC STRIKE ASSEMBLY". This design of electric strike assembly, as shown in FIGS. 2A, 2B and 2C, comprises a housing 70, a rear plate 77 covering the housing 70, a keeper 71 pivotally arranged in the housing 70, a holder 73 slidably arranged in the housing 70, a blocking element 74 configured to selectively prevent a rotation of the keeper 71 and allow the rotation of the keeper 71, a two-position mode selector 76 operable from outside the housing 70 and configured to selectively move the holder 73 from a first position to a second position and vice versa, and an actuator (solenoid device) 72 configured to selectively move the blocking element 74. When the holder 73 is in the first position, the blocking element 74 allows the rotation of the keeper 71 when the actuator 72 is energized and prevents the rotation of the keeper 71 when the actuator 72 is not energized, and when the holder 73 is in the second position, the blocking element 74 presents the rotation of the keeper 71 when the actuator 72 is energized and allows the rotation of the keeper 71 when the actuator 72 is not energized. This design of electric strike assembly is substantially similar to the aforesaid electrical lock device with the exception that the two-position mode selector 76 which is comprised of a slotted head 761, a pin 762 and a disk portion 763 is inserted into the slot 75 to control the movement of the holder 73 and to further control the position of the actuator 72 and the blocking element 74, achieving position control of the keeper 71. This design does not eliminate the drawback of the aforesaid electrical lock device. Further, because the mode selector 76 is installed in the bottom side of the housing 70, it is inconvenient to operate the mode selector 76.

SUMMARY OF THE INVENTION

The present invention has been accomplished under the circumstances in view. It is therefore the main object of the present invention to provide a magnetic lock, which is conveniently adjustable between two modes to have the magnetic lock be locked or unlocked when electrically connected without opening the casing.

To achieve this and other objects of the present invention, the magnetic lock comprises a casing, a latch movably mounted inside the casing, and an electromagnetic valve, which has a reciprocating rod adapted to control movement of the latch, wherein a stop block is affixed to the reciprocating rod of the electromagnetic valve corresponding to the latch, a holder member is provided inside the casing to hold the electromagnetic valve, and adjustment means extending out of the casing for operation by the user to move the holder member and the electromagnetic valve between a first position where the magnetic lock is locked when electrically connected and a second position where the magnetic lock is unlocked when electrically connected.

DETAILED DESCRIPTION OF THE PREFERRED EMBODIMENT

Figure 1A:
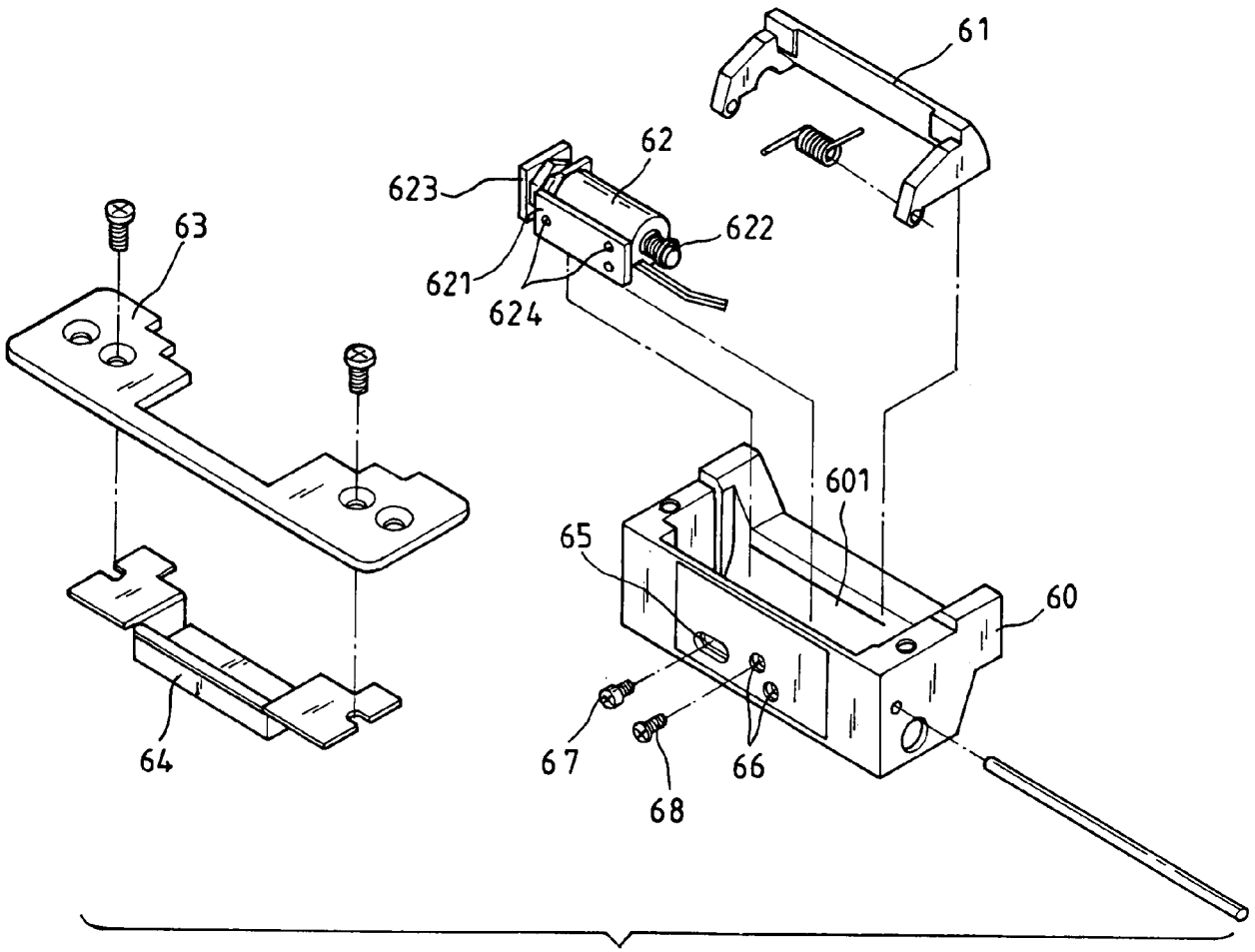
FIG.1A (PRIOR ART)
FIG. 1A is an exploded view of the electrical lock device according to U.S. Pat. No. 6,299,225.
Figure 1B:
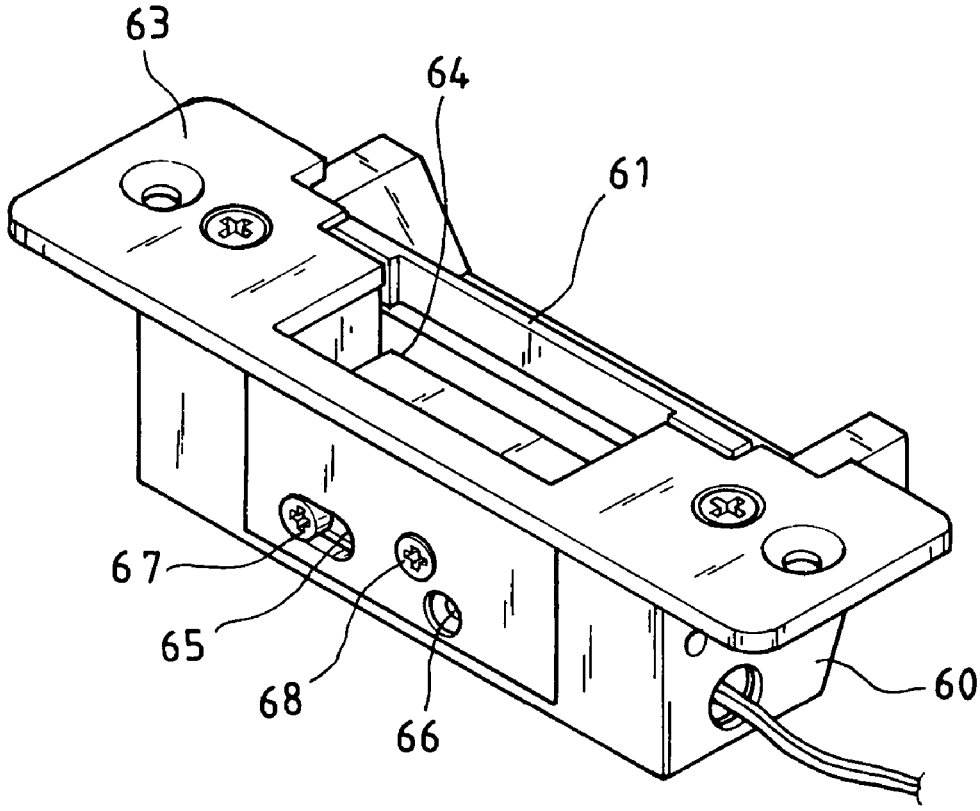
FIG. 1B (PRIOR ART)
FIG. 1B is an elevational assembly view of the electrical lock device according to U.S. Pat. No. 6,299,225.
Figure 2A:
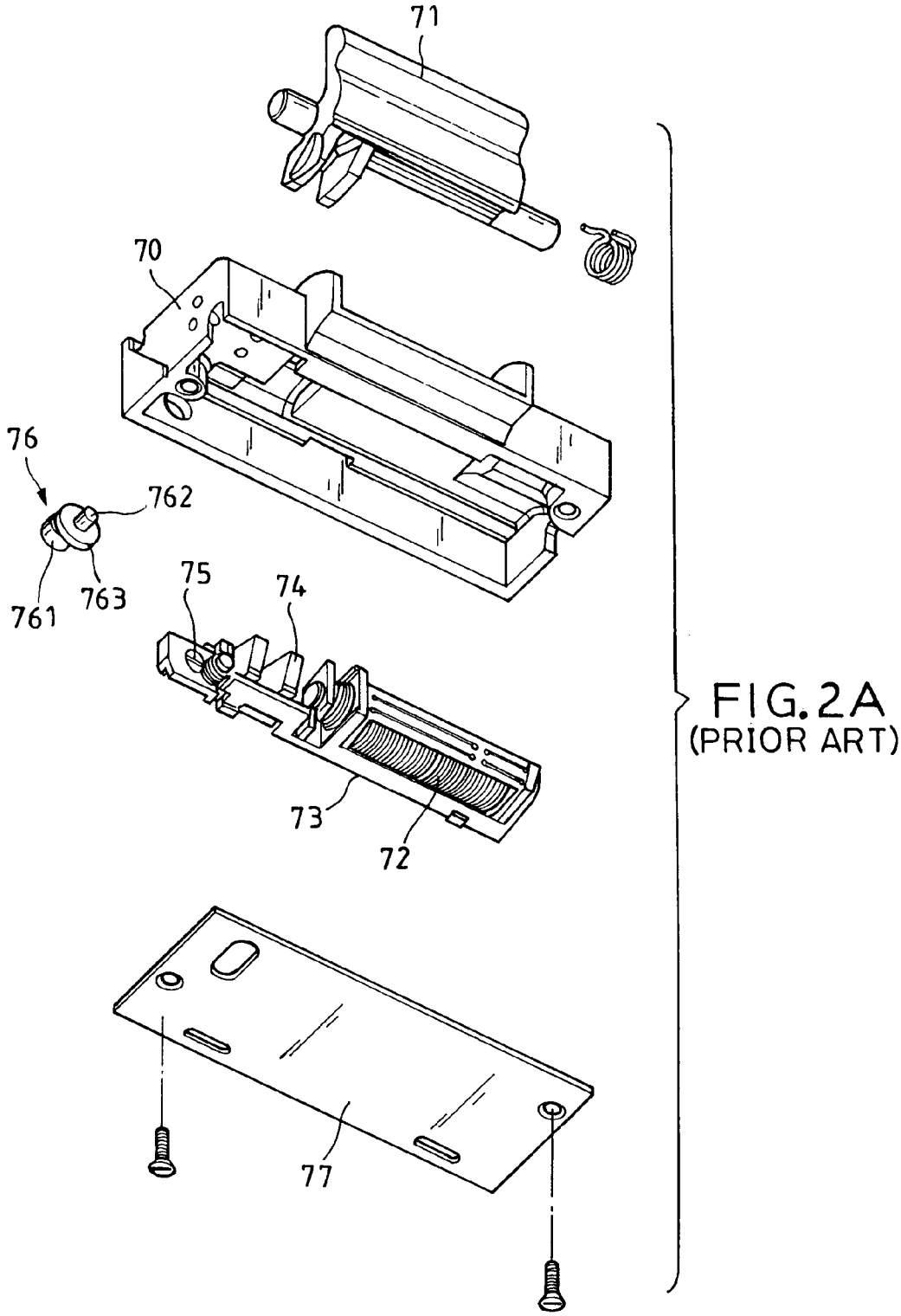
FIG. 2A (PRIOR ART)
FIG. 2A is an exploded view of the electric strike assembly according to U.S. Pat. No. 6,874,830.
Figure 2B:
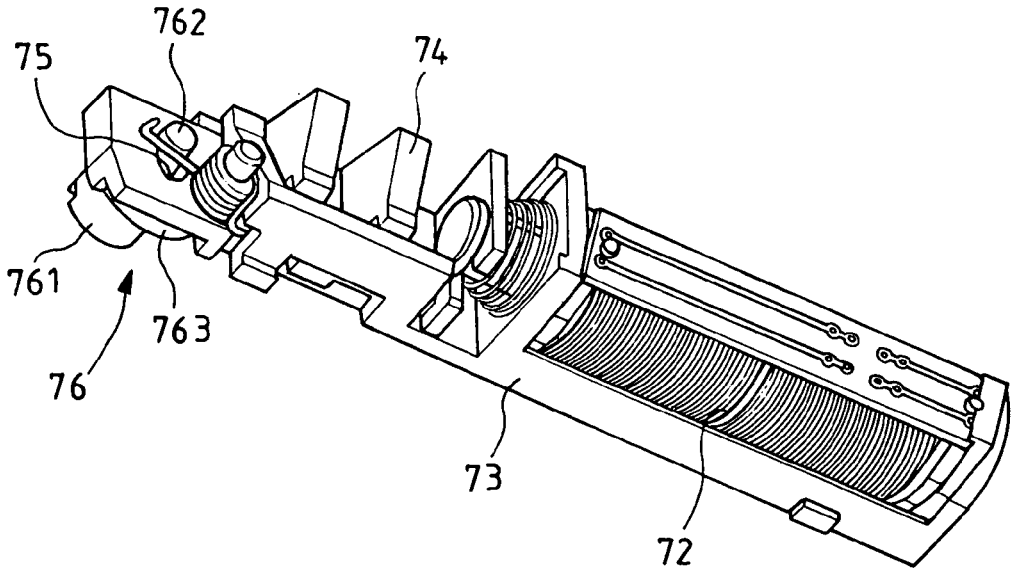
FIG. 2B (PRIOR ART)
FIG. 2B is an elevational assembly view of a part of the electric strike assembly according to U.S. Pat. No. 6,874, 830.
Figure 2C:
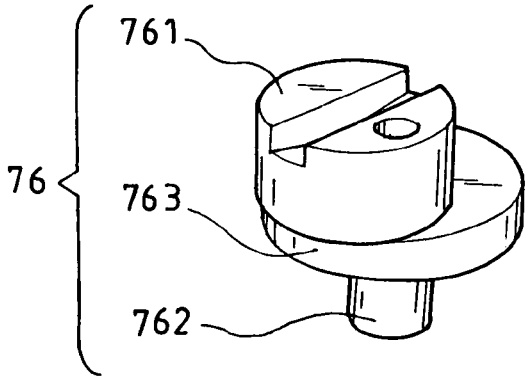
FIG. 2C (PRIOR ART)
FIG. 2C is an elevational view of the mode selector for the electric strike assembly according to U.S. Pat. No. 6,874, 830.
Figure 3:
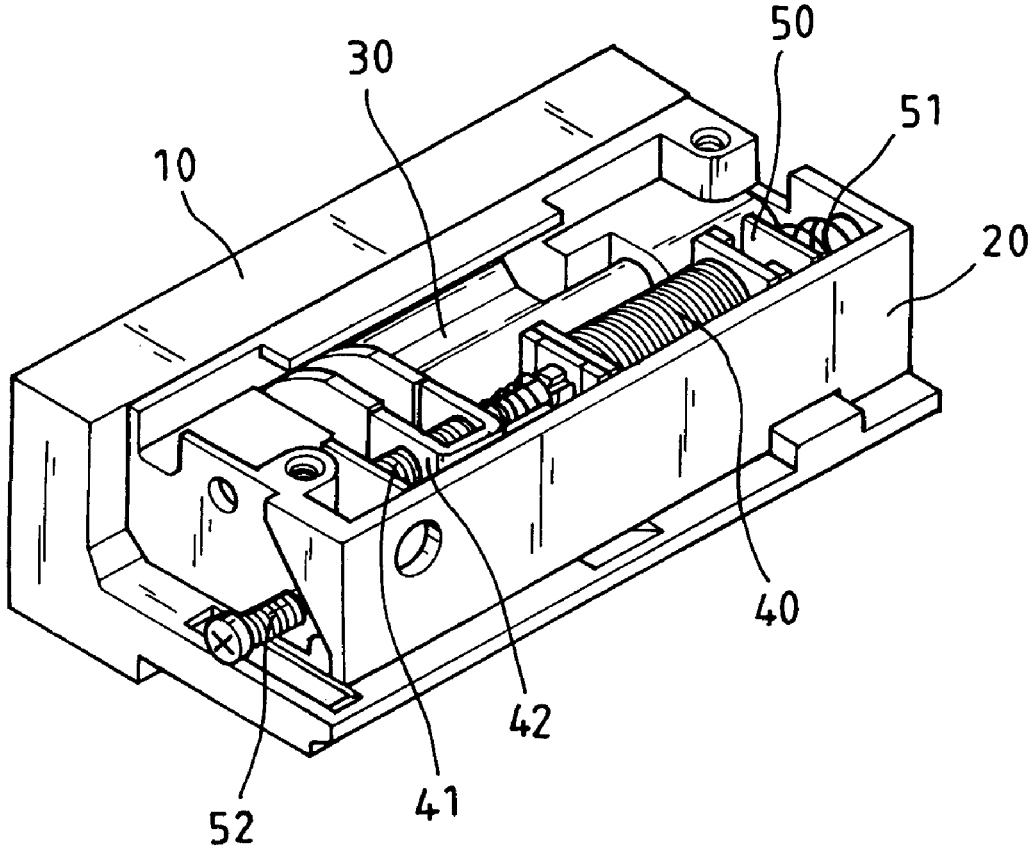
FIG. 3 is an elevational assembly view of a magnetic lock according to the present invention.
Figure 4:
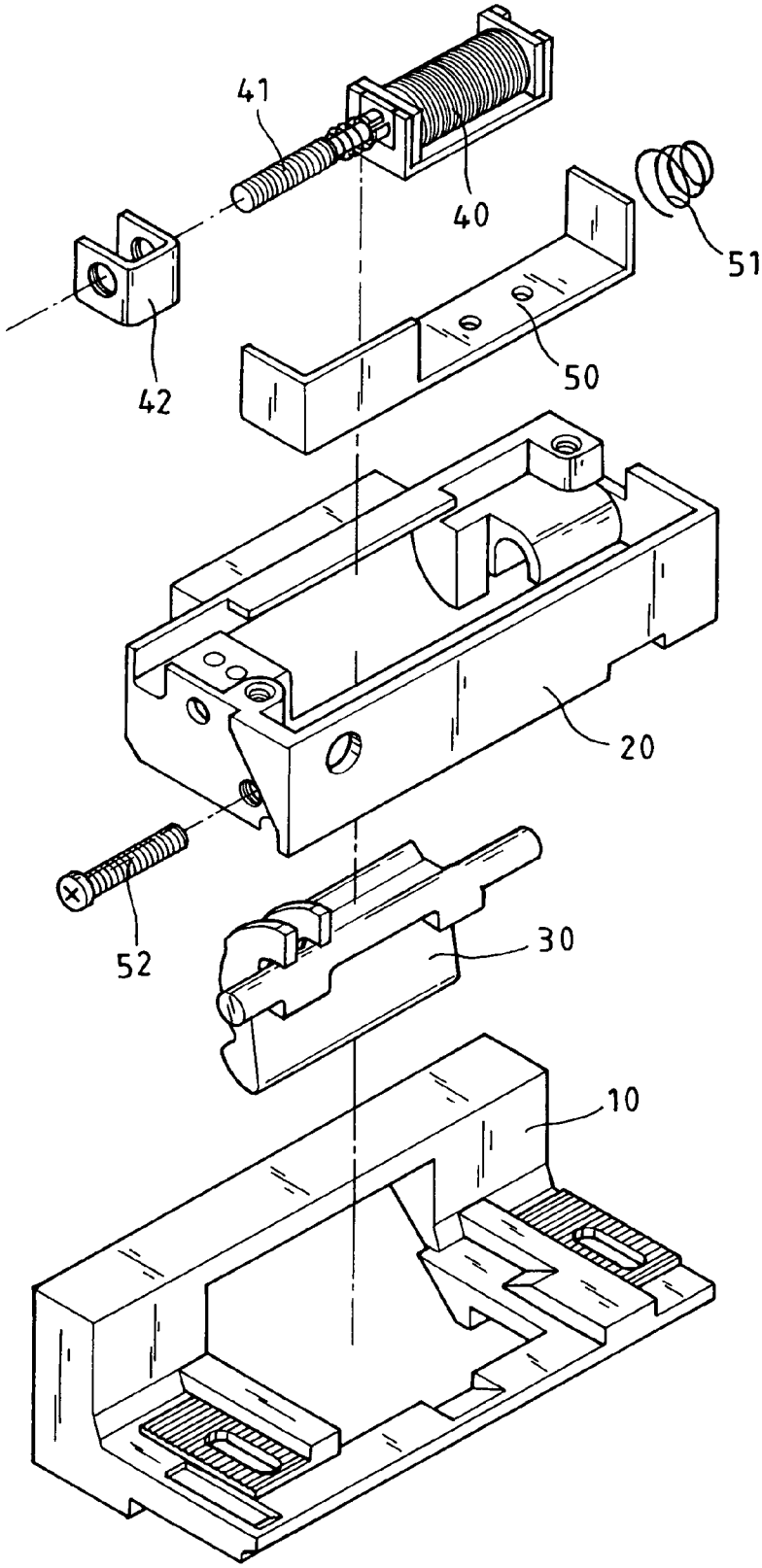
FIG. 4 is an exploded view of the magnetic lock according to the present invention.

Referring to FIGS. 3 and 4, a magnetic lock in accordance with the present invention is shown comprised of a bottom cover shell 10, a top cover shell 20, a latch 30, an electromagnetic valve 40, and a movable holder member 50 that carries the electromagnetic valve 40.

The electromagnetic valve 40 has a reciprocating rod 41 mounted with a stop block 42 corresponding to the latch 30. The movable holder member 50 is movably mounted inside the top cover shell 20 and adapted to control the return stroke of the latch 30. The movable holder member 50 has one end supported on a spring member, for example, a compression spring 51 inside the top cover shell 20 and the other end stopped against an adjustment screw 52, which is mounted in one side of the top cover shell 20.

The main feature of the present invention is that the compression spring 51 and the adjustment screw 52 are respectively provided at the rear and front sides of the movable holder member 50. Further, these three members, namely, the compression spring 51, a movable holder member 50 and the adjustment screw 52 are on the same moving axis X-X, as shown in FIGS. 5~8. Unlike the prior art design to have the adjustment device (mode selector or the like) set at the bottom side of the housing in perpendicular to the holder, the invention has the adjustment screw 52 be extended out of the front side of the top cover shell 20 for easy adjustment. Further, the compression spring 51 gives a holding down spring power, facilitating the adjustment of the adjustment screw 52.

Further, the reciprocating rod 41 according to the present preferred embodiment is a screw rod. However, the screw rod is not a limitation. Further, the stop block 42 according to the present preferred embodiment has a U-shaped profile and two axially aligned screw holes, and is fastened to the reciprocating rod 41 at a predetermined location. This design facilitates adjustment of the position of the stop block 42 in the reciprocating rod 41. Alternatively, the stop block 42 can be directly affixed to the reciprocating rod 41.

Figure 5:
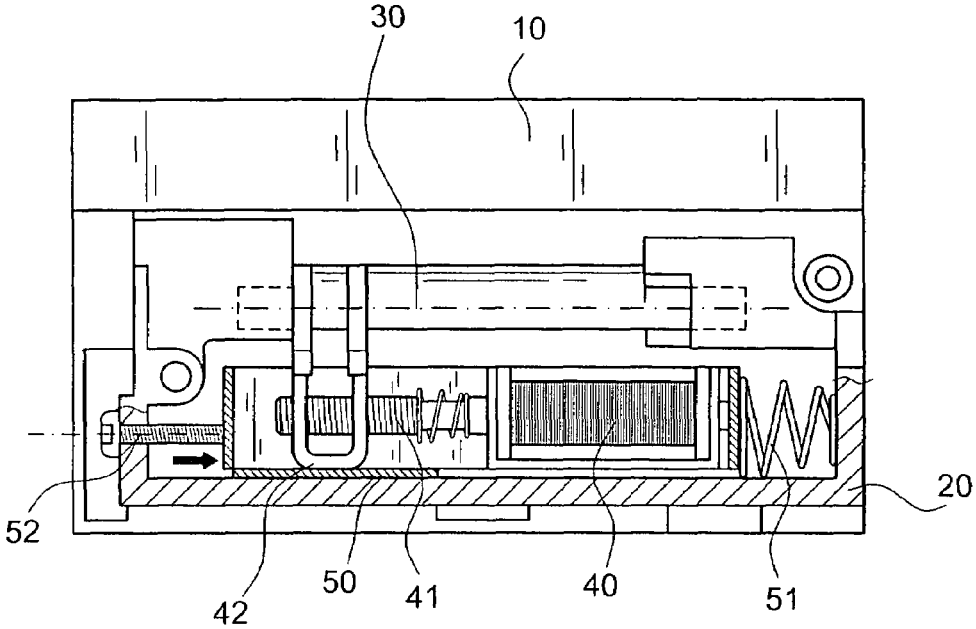
FIG. 5 is a schematic sectional view showing the status of "unlocking upon connection of electricity" of the magnetic lock according to the present invention (I).
Figure 6:
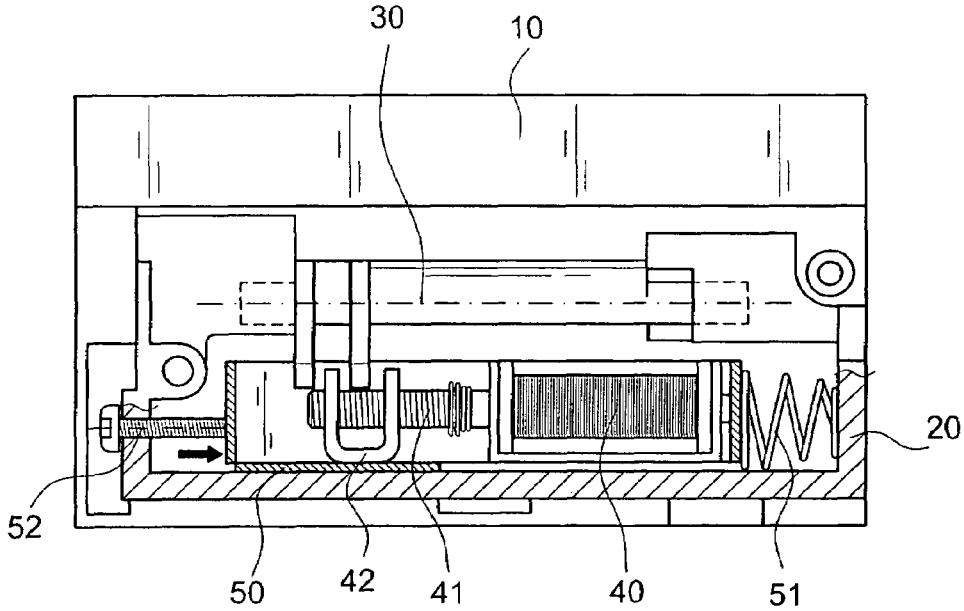
FIG. 6 is a schematic sectional view showing the status of "unlocking upon connection of electricity" of the magnetic lock according to the present invention (II).

Referring to FIGS. 5 and 6, when rotated the adjustment screw 52 inwards to the inner limit position, i.e., when fastened up the adjustment screw 52, the stop block 42 stops the latch 30 from backward movement before connection of electricity to the electromagnetic valve 40. When the electromagnetic valve 40 is electrically connected to retract the reciprocating rod 41 and the stop block 42, the stop block 42 does not hinder backward movement of the latch 30. Therefore, the magnetic lock is unlocked when electrically connected after fastened up the adjustment screw 52.

Figure 7:
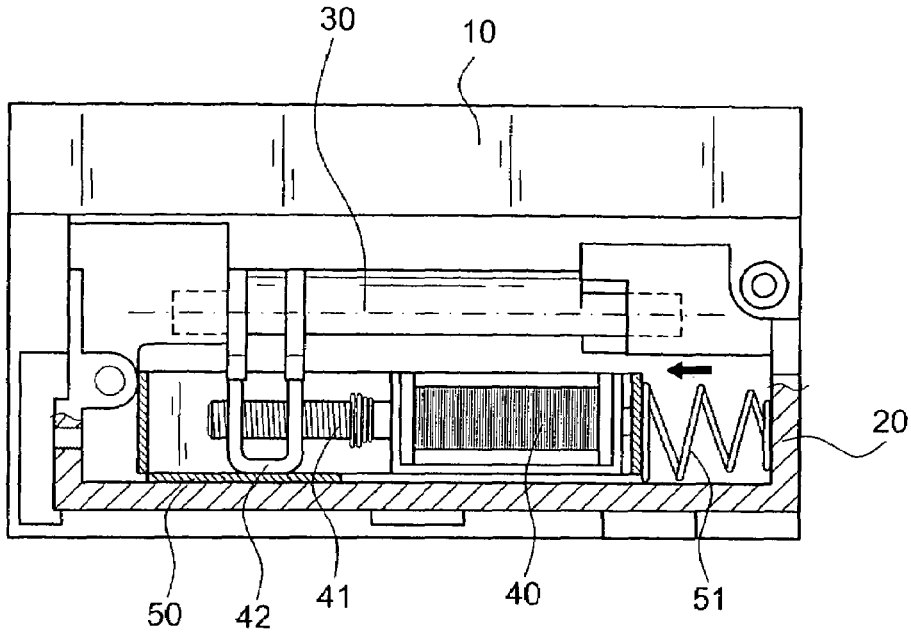
FIG. 7 is a schematic sectional view showing the status of "locking upon connection of electricity" of the magnetic lock according to the present invention (I).
Figure 8:
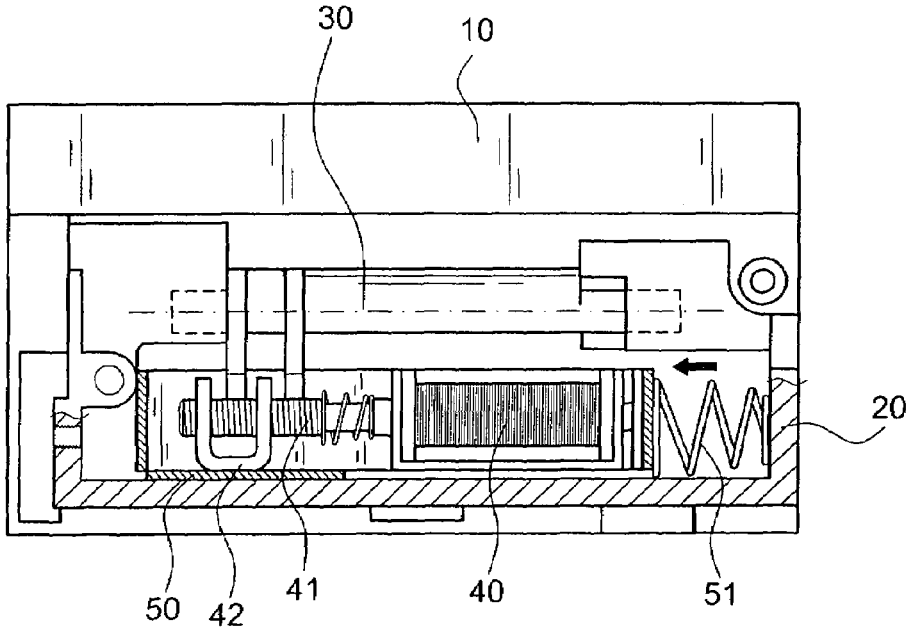
FIG. 8 is a schematic sectional view showing the status of "locking upon connection of electricity" of the magnetic lock according to the present invention (II).

Referring to FIGS. 7 and 8, when loosened the adjustment screw 52, the conical spring 51 pushes the movable holder member 50 and the electromagnetic valve 40 outwards to a locking position where the stop block 42 stops the latch 30 from movement upon connection of electricity to the electromagnetic valve 40. Therefore, the magnetic lock is locked when electrically connected after loosened the adjustment screw 52.

As indicated above, the adjustment screw 52 is provided on the outside of the magnetic lock, and the user can operate the adjustment screw 52 to adjust the operation mode of the magnetic lock.

A prototype of magnetic lock has been constructed with the features of the annexed drawings of FIGS. 3~8. The magnetic lock functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A magnetic lock comprising:

a bottom cover shell;

a top cover shell fastened to said bottom cover shell;

a latch mounted inside said top cover shell;

an electromagnetic valve, said electromagnetic valve having a reciprocating rod, a stop block being mounted on said reciprocating rod, said stop block being linearly displaceable responsive to displacement of said reciprocating rod;

a movable holder member carrying said electromagnetic valve and being movably mounted inside said top cover shell and adapted to control the return stroke of said latch;

wherein said movable holder member has one end supported on a compression spring inside said top cover shell and an opposite end stopped against an adjustment screw, said adjustment screw being mounted in one side of said top cover shell and kept in axial alignment with said movable holder member and said compression spring on a moving axis X-X;

wherein when said adjustment screw is tightened the stop block does not hinder movement of the latch when the electromagnetic valve is energized, and when said adjustment screw is loosened the stop block prevents movement of the latch when the electromagnetic valve is energized.

2. The magnetic lock as claimed in claim 1, wherein said reciprocating rod is a threaded rod; said stop block is a U-shaped member screwed onto said threaded rod.

* * * * *